US011731387B2

(12) United States Patent
Nobe et al.

(10) Patent No.: US 11,731,387 B2
(45) Date of Patent: Aug. 22, 2023

(54) BAG MAKING MACHINE AND BAG MAKING METHOD

(71) Applicant: HOSOKAWA YOKO CO., LTD., Tokyo (JP)

(72) Inventors: Shintaro Nobe, Tokyo (JP); Kazuhiro Umenaka, Tokyo (JP)

(73) Assignee: HOSOKAWA YOKO CO., LTD., Tokyo (JP)

( * ) Notice: Subject to any disclaimer, the term of this patent is extended or adjusted under 35 U.S.C. 154(b) by 100 days.

(21) Appl. No.: 17/621,887

(22) PCT Filed: Jul. 3, 2020

(86) PCT No.: PCT/JP2020/026243
§ 371 (c)(1),
(2) Date: Dec. 22, 2021

(87) PCT Pub. No.: WO2021/006216
PCT Pub. Date: Jan. 14, 2021

(65) Prior Publication Data

US 2022/0242080 A1 Aug. 4, 2022

(30) Foreign Application Priority Data

Jul. 5, 2019 (JP) ..... 2019-125859

(51) Int. Cl.
*B31B 70/81* (2017.01)
*B31B 70/64* (2017.01)
(Continued)

(52) U.S. Cl.
CPC ..... *B31B 70/8131* (2017.08); *B31B 70/645* (2017.08); *B31B 2160/102* (2017.08); *B31B 2170/20* (2017.08)

(58) Field of Classification Search
CPC ..... B29C 65/00; B29C 65/04; B29C 65/18; B29C 65/08; B29C 66/8322; B31B 70/8131; B31B 70/654; B31B 1/00
(Continued)

(56) References Cited

U.S. PATENT DOCUMENTS

2004/0020166 A1* 2/2004 Cortigiano, Sr. ... B29C 66/3452 53/139.2
2004/0226645 A1* 11/2004 Owen ..... B29C 66/81611 156/580.2
2006/0252625 A1* 11/2006 Owen ..... B65B 61/188 493/394

FOREIGN PATENT DOCUMENTS

CN 1541899 11/2004
CN 106809444 6/2017
(Continued)

OTHER PUBLICATIONS

Chinese Search Report (Application No. 202080047504.2) dated Feb. 13, 2023 (10pgs).
(Continued)

*Primary Examiner* — Andrew M Tecco
*Assistant Examiner* — Jacob A Smith
(74) *Attorney, Agent, or Firm* — Nixon Peabody LLP; Jeffrey L. Costellia

(57) ABSTRACT

The present invention is a bag making machine (20, 30). The bag making machine (20, 30) includes: a conveying unit (37) which conveys a multi-layer film (S) in which films (13*a*, 13*b*) are overlapped; a side edge sealing device (27) which thermally fuses the films (13*a*, 13*b*) to each other; and an ultrasonic device (26) which crushes a part of a zipper member (14) disposed between films (13*a*, 13*b*). The side edge sealing device (27) includes: a platform (44); and a heat-generating head (45). The ultrasonic device (26) includes: an anvil (41); and an ultrasonic horn head (42). The
(Continued)

heating-generating head (45) and the ultrasonic horn head (42) reciprocate at a same cycle via a link member (51).

5 Claims, 6 Drawing Sheets

(51) Int. Cl.
*B31B 170/20* (2017.01)
*B31B 160/10* (2017.01)

(58) Field of Classification Search
USPC ..... 493/189, 394
See application file for complete search history.

(56) References Cited

FOREIGN PATENT DOCUMENTS

| | | |
|---|---|---|
| CN | 108698357 | 10/2018 |
| CN | 109640919 | 4/2019 |
| JP | 2008-114546 | 5/2008 |
| JP | 2014-180774 | 9/2014 |
| JP | 2015-016900 | 1/2015 |
| JP | 2017-105517 | 6/2017 |

OTHER PUBLICATIONS

International Search Report for PCT/JP2020/026243, dated Sep. 24, 2020, 4 pages.

* cited by examiner

BAG MAKING MACHINE AND BAG MAKING METHOD

TECHNICAL FIELD

The present invention relates to a bag making machine and a bag making method using the same. Priority is claimed on Japanese Patent Application No. 2019-125859, filed Jul. 5, 2019, the content of which is incorporated herein by reference.

BACKGROUND ART

A zipper bag, in which an opening portion can be opened and closed by a zipper member formed inside the bag after a seal of an end portion is opened, is known. When such a zipper bag is made, the zipper member is disposed between two resin films, and after the zipper member is joined to a resin film in a longitudinal direction, two resin films are thermally fused together in a portion which is a peripheral edge portion of the bag.

However, when the portion that is the peripheral edge portion of the bag is thermally fused, there is a part on the peripheral edge portion in which both end portions of the zipper member overlap. Since a thickness of the zipper member is thick, if the part is thermally fused as it is, there is a concern that gaps will be formed at both end portions of the zipper member and internal airtightness will not be maintained. Therefore, before thermally fusing the resin films to each other in the portion that is the peripheral edge portion of the bag, it is common to soften both end portions of the zipper member with an ultrasonic device and crush them in advance so that the thickness becomes thin (see, for example, Patent Document 1).

The ultrasonic device for crushing both end portions of such a zipper member is equipped with an anvil (i.e., a platform) that supports the other surface side of the resin film, and an ultrasonic horn that moves up and down between a position adjacent to one surface side of the resin film and a retracted position. In the related art, such an ultrasonic horn reciprocates using an air cylinder as a power source (see, for example, Patent Document 2).

CITATION LIST

Patent Document

[Patent Document 1]

Japanese Unexamined Patent Application, First Publication No. 2008-114546

[Patent Document 2]

Japanese Unexamined Patent Application, First Publication No. 2014-180774

Technical Problem

However, the air cylinder that reciprocally moves the ultrasonic horn is a mechanism in which the cylinder is filled with a squeezed gas and a piston connected to the ultrasonic horn rises when a pressure reaches a predetermined level or higher. Therefore, a response speed was slow, and there was a limit to the number of times the ultrasonic horn could reciprocate per unit time. Therefore, there is a problem that it is difficult to improve the manufacturing efficiency of a zipper bag.

On the other hand, in a process of thermally fusing the portion that is the peripheral edge portion of the bag, which is a process performed after a process of crushing both end portions of the zipper member, a heat-generating head is made to reciprocate using a motor and a cam mechanism. Therefore, there is a concern that a reciprocating cycle of the heat-generating head and the ultrasonic horn may deviate from the resin film conveyed at a constant speed.

The present invention has been made in consideration of such circumstances, and an object of the present invention is to provide a bag making machine which is capable of improving the manufacturing efficiency of a zipper bag, and facilitates synchronization of processes.

Solution to Problem

In order to solve the above problems, the present invention proposes the following means.

According to a first aspect of the present invention, there is provided a bag making machine that includes: a conveying unit which conveys a multi-layer film in which strip-shaped films are overlapped; a side edge sealing device which thermally fuses the films to each other at predetermined intervals in a width direction that is perpendicular to a conveying direction of the multi-layer film; and an ultrasonic device which is disposed on an upstream side of the side edge sealing device in the conveying direction and softens and crushes a part of a zipper member with ultrasonic waves, the zipper member disposed between the films such that a longitudinal direction follows the conveying direction. In the bag making machine, the side edge sealing device includes: a platform which supports the multi-layer film; and a heat-generating head which reciprocates between a position adjacent to the multi-layer film and a position separated from the multi-layer film. The ultrasonic device includes: an anvil which supports the multi-layer film; and an ultrasonic horn head which reciprocates between a position adjacent to the multi-layer film and a position separated from the multi-layer film. The heat-generating head and the ultrasonic horn head reciprocate at a same cycle via a link member common to the heat-generating head and the ultrasonic horn head reciprocate.

Further, according to a second aspect of the present invention, in the first aspect described above, the link member is connected to a single rotating device and a cam mechanism.

Further, according to a third aspect of the present invention, in the first or second aspect described above, the ultrasonic horn head is urged toward the multi-layer film by a spring.

Further, according to a fourth aspect of the present invention, in any one of the first to third aspects described above, the bag making machine further includes: a punching device which is disposed on a downstream side of the side edge sealing device in the conveying direction to punch a part of the multi-layer film. In the bag making machine, the punching device includes: a female blade which supports the multi-layer film; and a male blade which reciprocates between a position at which the male blade is fitted into the female blade and in which the male blade punches a part of the multi-layer film and a position separated from the multi-layer film, and which punches the part of the multi-layer film. The heat-generating head, the ultrasonic horn head, and the male blade reciprocate at the same cycle via the link member.

Further, according to a fifth aspect of the present invention, there is provided a bag making method using the bag making machine according to any one of the first to fourth aspects described above. The method including at least: a process of placing the zipper member between the films so that a longitudinal direction follows the conveying direction; a process of softening and crushing both end portions of the zipper member with ultrasonic waves; and a process of thermally fusing the films at predetermined intervals in the width direction.

Effects of Invention

According to the present invention, it is possible to provide a bag making machine which is able to improve the manufacturing efficiency of a zipper bag, and facilitates synchronization of processes.

DESCRIPTION OF EMBODIMENTS

Hereinafter, a bag making machine according to an embodiment of the present invention and a bag making method using the same will be described with reference to the drawings. It should be noted that the embodiments shown below are specifically described so that the spirit of the invention can be better understood, and are not intended to limit the present invention unless otherwise specified. Further, the drawings used in the following description may be shown with the main parts enlarged for convenience to make the features of the present invention easy to understand, and the dimensional ratios of the respective constituent elements are not always the same as the actual ones.

(Zipper Bag)

Figure 1:
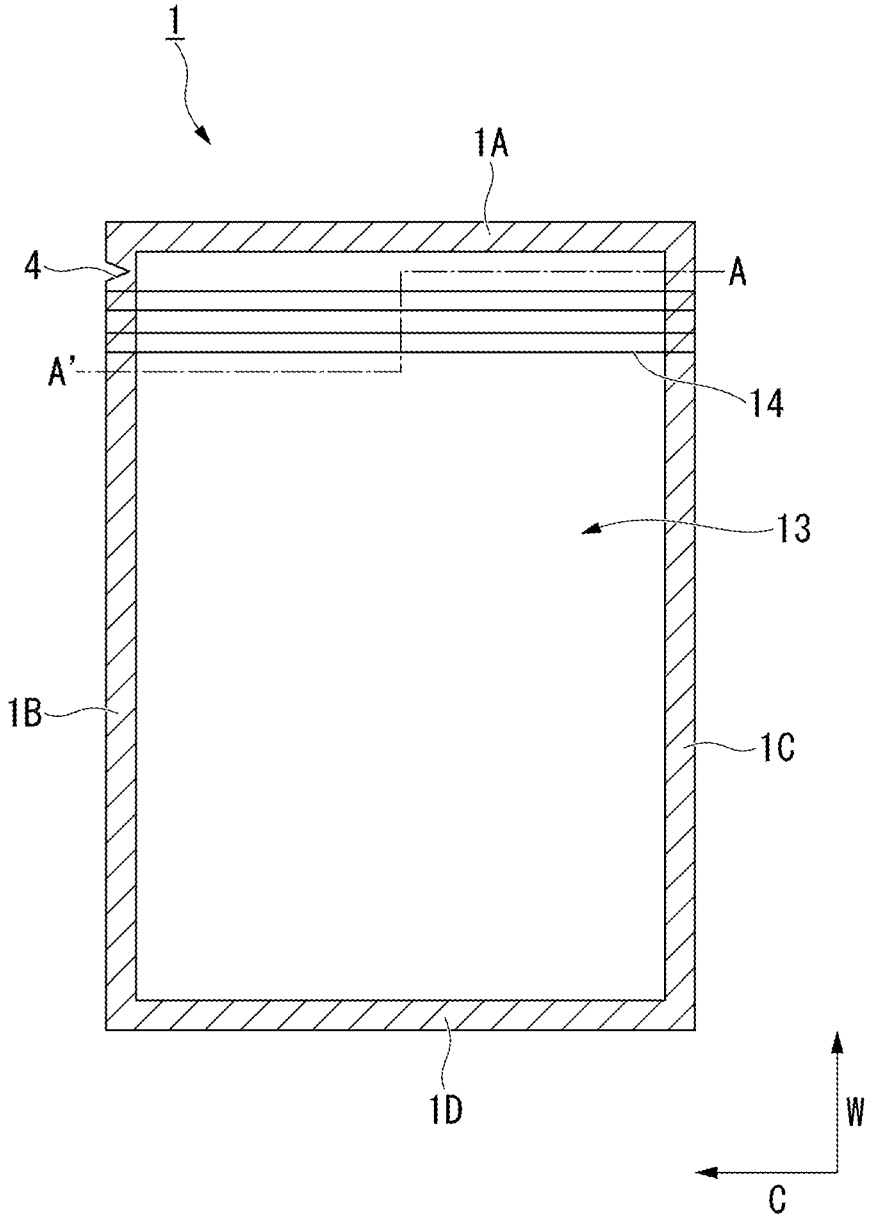
FIG. 1 is a front view showing an example of a zipper bag.
Figure 2:
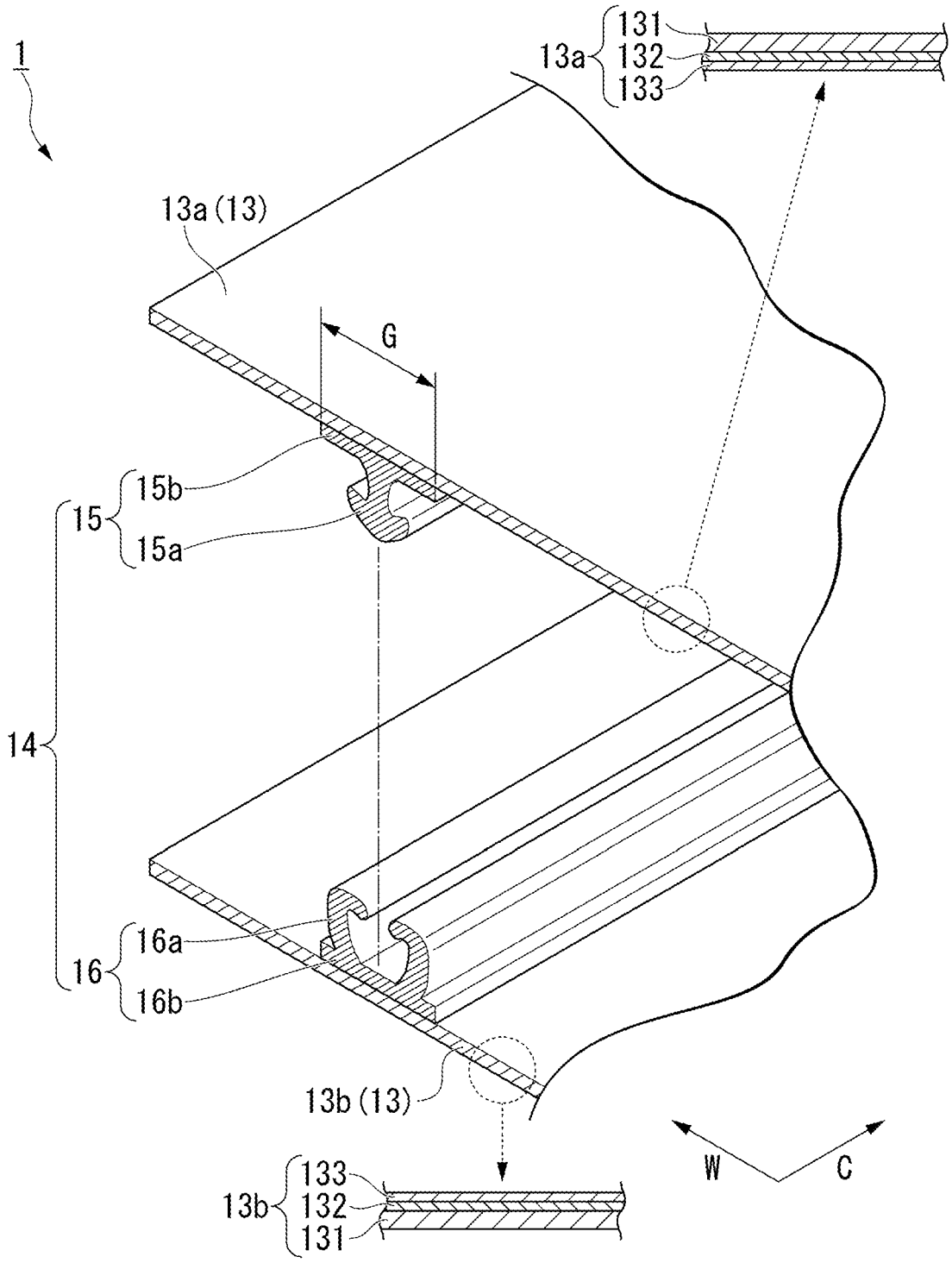
FIG. 2 is an enlarged perspective view of a main part showing a zipper formation portion of the zipper bag along a line A-A' of FIG. 1.

First, a zipper bag that can be manufactured by the bag making machine according to the embodiment of the present invention will be described. FIG. 1 is a front view showing an example of a zipper bag. Further, FIG. 2 is an enlarged perspective view of a main part showing the zipper member of the zipper bag and its periphery along the line A-A' of FIG. 1. The zipper bag 1 is, for example, a storage bag that can accommodate solid contents such as supplements, pharmaceuticals, and confectionery, and powdery or granular contents such as seasonings in an airtight state, and can be freely opened and closed by a zipper member 14 even after opening.

In the zipper bag 1, a portion in which two resin films 13*a* and 13*b* are overlapped and one side is thermally fused with a predetermined width is defined as a bottom portion 1D of the zipper bag 1. Further, portions in which the resin film 13*a* and the resin film 13*b* are thermally fused with a predetermined width at both end portions extending in a direction perpendicular to the bottom portion 1D are defined as side edge portions 1B and 1C. Further, a portion in which the resin film 13*a* and the resin film 13*b* are thermally fused with a predetermined width on the opposite side of the bottom portion 1D is defined as an opening portion 1A.

Further, the zipper member 14 is attached between the resin film 13*a* and the resin film 13*b* at a predetermined distance from the opening portion 1A to the bottom portion 1D side. Further, an opening notch 4 is formed between the opening portion 1A of the side edge portion 1B or the side edge portion 1C and the zipper member 14. The notch 4 may be formed between the opening portion 1A of the side edge portion 1B and the side edge portion 1C and the zipper member 14.

As shown in FIG. 2, the resin films 13*a* and 13*b* constituting the zipper bag 1 of the present embodiment each include a base material layer 131, an intermediate layer 132, and a thermal fusion layer 133. The base material layer 131 is designed, for example, to be located on the surface side of each of the resin films 13*a* and 13*b*. As the base material layer 131, a film having characteristics of excellent printability as well as puncture resistance, rigidity, impact resistance and the like is preferable. Specific examples of the material of the base material layer 131 include, for example, stretched films such as polyester, polyamide, and polypropylene. The thickness of the base material layer 131 is preferably in the range of, for example, about 5 μm to 50 μm.

Further, the intermediate layer 132 is arbitrarily formed depending on the type and amount of the contents to be accommodated in the zipper bag 1, and can also be omitted. As the intermediate layer 132, for the purpose of imparting gas barrier properties to the resin films 13*a* and 13*b*, in addition to metal foils such as aluminum, copper and magnesium, an inorganic vapor-deposited film formed by vapor-depositing a metal or a metal oxide such as aluminum, alumina or silica on the stretched films such as polyester, polyamide and polypropylene can be used.

Further, a stretched film such as polyester, polyamide or polypropylene can be used as the intermediate layer 132 to impart toughness such as piercing strength and drop strength to the resin films 13*a* and 13*b*. The thickness of the intermediate layer 132 is preferably in the range of, for example, about 5 μm to 50 μm. The intermediate layer 132 may be a single layer or may be provided as two or more layers as needed, but is not limited thereto.

The thermal fusion layer 133 is designed to be located on the innermost surface layer of the resin films 13*a* and 13*b*. The material of the thermal fusion layer 133 is not particularly limited as long as it is one that is usually used for resin films 13*a* and 13*b*. As examples of specific materials of the thermal fusion layer 133, polyolefins such as low-density polyethylene, medium-density polyethylene, high-density polyethylene, linear low-density polyethylene, and polypropylene are preferable from the viewpoint of enhancing the adhesiveness between the resin films 13*a* and 13*b* and the zipper member 14.

As the material of the thermal fusion layer 133, a combination of the same material as that of the zipper member 14 (for example, polyethylene for polyethylene and polypropylene for polypropylene) is preferable to further enhance the adhesiveness between the thermal fusion layer 133 and the zipper member 14. The thickness of the thermal fusion layer 133 is preferably in the range of, for example, about 20 μm to 150 μm.

In the resin films 13*a* and 13*b*, a thermally fusing resin can also be used for the base material layer 131. When the thermal fusion layer 133 is not required, the resin films 13*a* and 13*b* may be made up of the base material layer 131 alone. When the resin films 13*a* and 13*b* are made up of the base material layer 131 alone, it is necessary to use a resin film having a thermally fusible layer on the inner surface side on which the resin film 13*a* and the resin film 13*b* face each other. Further, the resin films 13*a* and 13*b* may be formed from two layers of the base material layer 131 and the thermal fusion layer 133 without providing the intermediate layer 132.

The zipper member 14 is attached to the inner surface side on which the resin film 13*a* and the resin film 13*b* face each other. The zipper member 14 is a member having a function of resealing the zipper bag 1. The zipper member 14 of the present embodiment is elongated, and has an insertion portion 15 and a receiving portion 16 that are fitted to each other. The insertion portion 15 has a ridge 15*a* and a platform 15*b*. Further, the receiving portion 16 has a groove 16*a* at which the ridge 15*a* can be attached and detached, and a platform 16*b*.

The shape of the zipper member 14 is not limited to the aforementioned shape, and is not particularly limited as long as the zipper bag 1 provided with the zipper member 14 can be resealed. For example, the zipper member 14 may not have a fitting portion of a concave-convex shape, and may be, for example, a hook-and-loop fastener or the like.

There is no limit to the size of the zipper member 14, and the size of the zipper member 14 can be set depending on the volume of the packaging bag to be manufactured and depending on the application. For example, a width G of the platforms 15*b* and 16*b* of the zipper member 14 may be formed to be 3 mm to 20 mm.

The zipper member 14 of this embodiment is made of a polyolefin. Polyethylene and polypropylene are preferable as the polyolefin. Low-density polyethylene and linear low-density polyethylene are preferable as the polyethylene, because they are excellent in flexibility and cold resistance. Further, the zipper member 14 may include various components as long as it does not deviate from the spirit of the present invention.

As the zipper member 14, for example, a zipper member obtained by melt extrusion molding of a polyolefin resin composition with an extruder equipped with a die may be used, or a zipper member commercially available from an individual company may be used.

The platforms 15*b* and 16*b* of the zipper member 14 are preferably, for example, 30 μm to 500 μm. The thickness referred to here is an average value obtained by photographing a cross section of an object cut in the vertical direction with a differential interference microscope and measuring it at any five points.

When the platform 15*b* of the insertion portion 15 and the resin film 13*a*, and the platform 16*b* of the receiving portion 16 and the resin film 13*b* are made of materials that are not thermally fused to each other, a thermal fusion layer (that is not shown) for thermally fusing between the platform 15*b* of the insertion portion 15 and the resin film 13*a*, and between the platform 16*b* of the receiving portion 16 and the resin film 13*b* may be formed.

The zipper bag 1 having such a configuration is cut from a long strip-shaped resin film (i.e., film) 13 when the bag is made with a bag making machine that will be described later. The long strip-shaped resin film (i.e., film) 13 is conveyed in a conveying direction indicated by an arrow C in FIG. 1 and is a film in which the resin film 13*a* and the resin film 13*b* overlap each other. In the following description, a direction perpendicular to the conveying direction C is referred to as a width direction W.

When the zipper member 14 is joined between the resin film 13*a* and the resin film 13*b*, both end portions in the longitudinal direction, that is, a portion which overlaps the side edge portions 1B and 1C in which the resin film 13*a* and the resin film 13*b* are thermally fused, is crushed. Both end portions in the longitudinal direction of the zipper member 14 referred to here are portions corresponding to the (overlapping) side edge portions 1B and 1C of the zipper bag 1 within the zipper member 14 disposed in the width direction W of FIG. 1 to extend in the longitudinal direction.

The zipper bag 1 having the above configuration is opened by cutting the opening portion 1A from the notch 4 in the conveying direction C. Accordingly, the contents can be taken out. Further, by fitting the insertion portion 15 and the receiving portion 16 of the zipper member 14, the opened zipper bag 1 can be closed with the contents left inside.

As the zipper bag 1, in addition to a material formed by superimposing the two resin films 13*a* and resin film 13*b* as in the above-described embodiment, a material in which one resin film 13 is folded back and superposed to provide the resin film 13*a* and the resin film 13*b* with the folded-back portion as a boundary may be formed. In this case, the bottom portion 1D may be used as the folded-back portion of the resin film 13, and conversely, the opening portion 1A may be used as the folded-back portion of the resin film 13. Further, the shape of the zipper member is not particularly limited as long as it can be opened and closed.

(Bag Making Machine)

Figure 3:
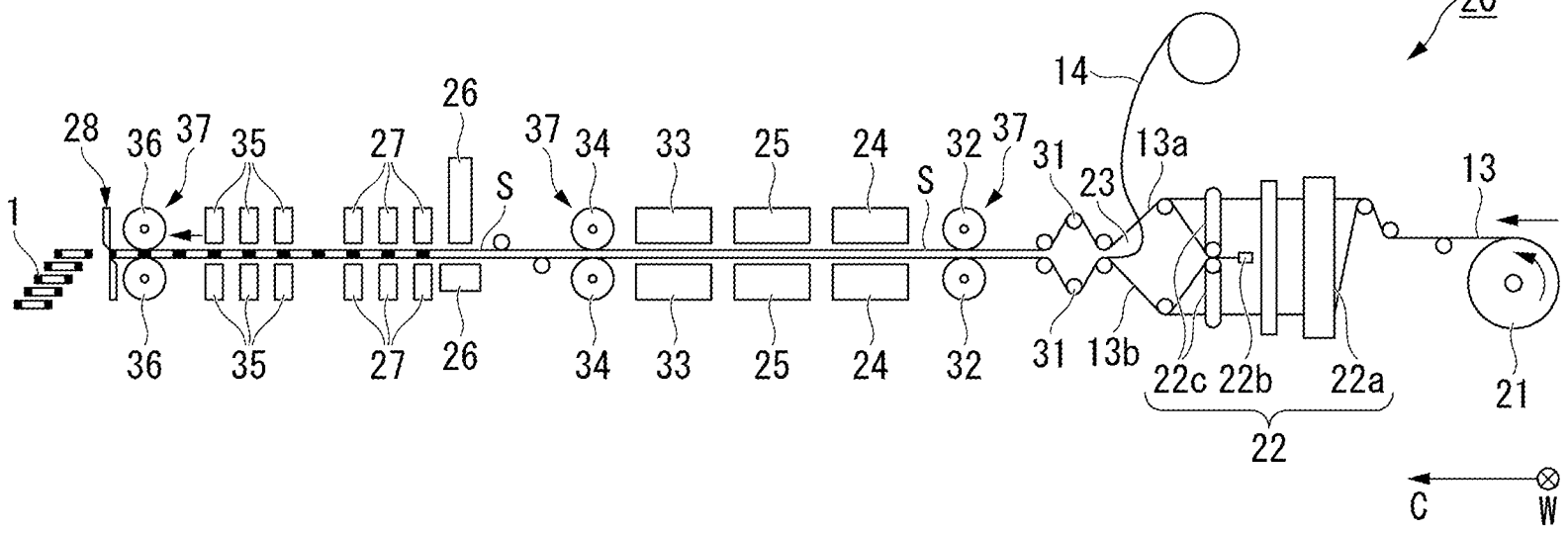
FIG. 3 is a schematic view showing a schematic configuration of a bag making machine according to an embodiment of the present invention.
Figure 4:
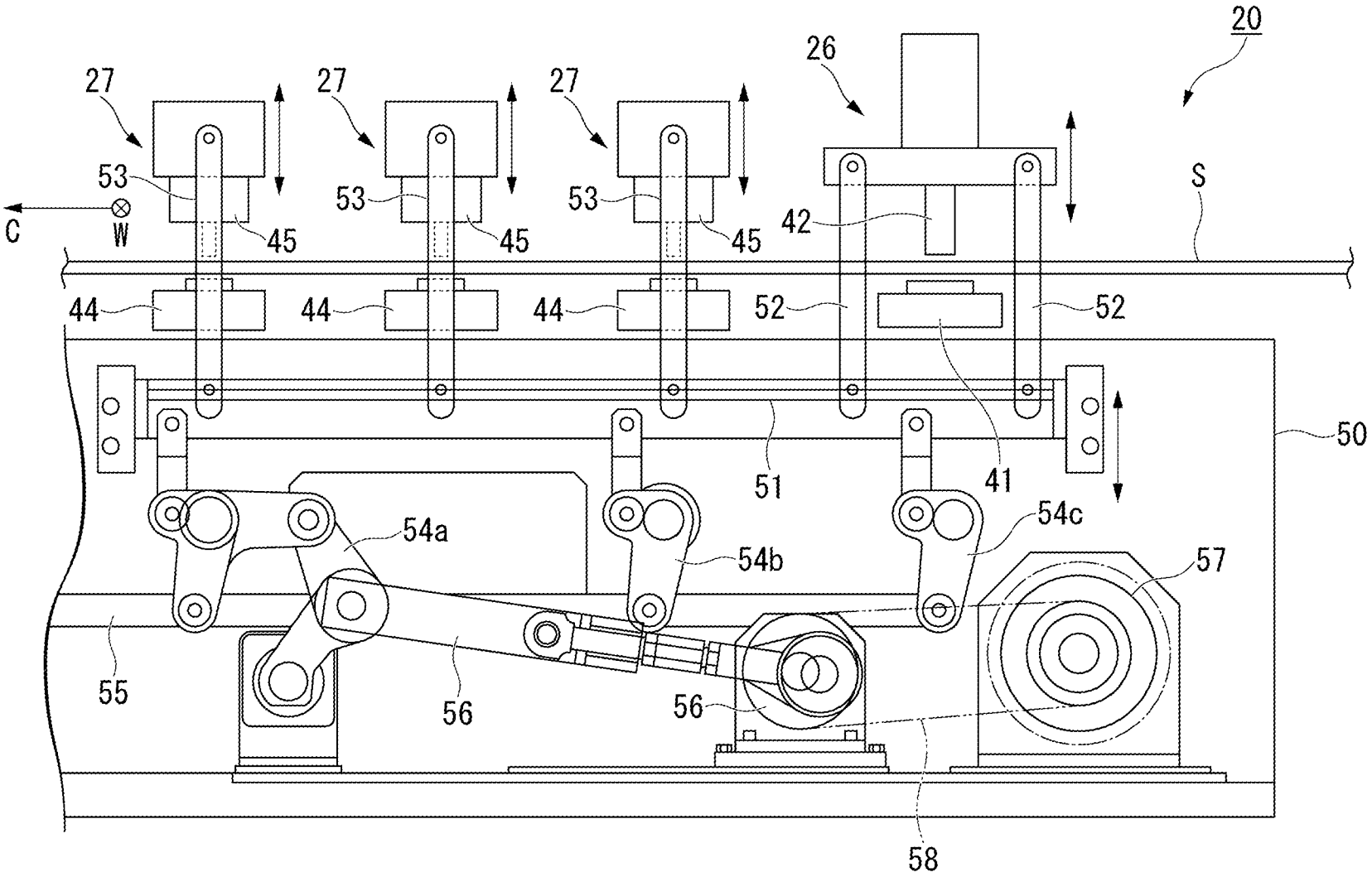
FIG. 4 is a schematic configuration diagram showing a drive mechanism that drives an ultrasonic device and a side edge sealing device.

A bag making machine according to an embodiment of the present invention will be described. FIG. 3 is a schematic view showing a schematic configuration of the bag making machine according to an embodiment of the present invention. Further, FIG. 4 is a schematic configuration diagram showing a drive mechanism for driving an ultrasonic device and a side edge sealing device. In the bag making machine 20 of the present embodiment, a resin film supply unit 21, an inversion cutting unit 22, a zipper member introduction unit 23, a zipper seal device 24, a vertical edge sealing device 25, an ultrasonic device 26, a side edge sealing device 27, and a cutter unit 28 are provided sequentially in the conveying direction C.

Further, a dancer roll 31 and a front stage conveying roll 32 are formed between the zipper member introduction unit 23 and the zipper seal device 24. Further, a first cooling unit 33 and an intermediate conveying roll 34 are formed between the vertical edge sealing device 25 and the ultrasonic device 26. Further, a second cooling unit 35 and a rear stage conveying roll 36 are formed between the side edge sealing device 27 and the cutter unit 28.

A conveying unit 37 is configured by the front stage conveying roll 32, the intermediate conveying roll 34, and the rear stage conveying roll 36 among them, and conveys a multi-layer film S in which a plurality of resin films 13 supplied from the resin film supply unit 21 are overlapped in the conveying direction C. The conveying unit 37 intermittently conveys the multi-layer film S to repeatedly convey and stop the multi-layer film S at a length equivalent to the zipper bag 1. Further, when the multi-layer film S is stopped, the ultrasonic horn head 42, the heat-generating head 45, the first cooling unit 33 (i.e., a cooling head to be described below), the second cooling unit 35 (i.e., a cooling head to be described below), and the cutting blade of the cutter unit 28 are moved up and down (i.e., reciprocal movement) together at the same cycle without causing deviation, via the link member 51 to be described below. FIG. 3 schematically shows an example of a link member 51 to explain a mechanism for moving the ultrasonic horn head 42 and the heat-generating head 45 up and down (i.e., reciprocal movement) together at the same cycle. The dimensions of the link member 51 extending in the conveying direction C may be adjusted as appropriate to move the members other than the ultrasonic horn head 42 and the heat-generating head 45 disposed in the conveying direction C up and down (i.e., reciprocal movement) at the same cycle as the ultrasonic horn head 42 and the heat-generating head 45. In the present embodiment, at least the ultrasonic horn head 42 and the heat-generating head 45 may be connected to the link member 51. In this embodiment, two rows of zipper bags 1 can be manufactured in the width direction of the resin film 13.

The resin film supply unit 21 supplies a long strip-shaped resin film (i.e., film) 13 from, for example, a resin film roll.

The inversion cutting unit 22 changes the conveying direction of the resin film 13 fed from the resin film supply unit 21 at an angle of 90° by a turn bar 22*a*. Next, the center blade 22*b* cuts the resin film 13 into two parts at a center position in the width direction W. Further, the directions of the two cut resin films 13*a* and 13*b* are changed again at an angle of 90° by an M-shaped plate 22*c*. As a result, the inner surfaces of each of the resin films 13*a* and 13*b* are superposed while facing each other. As a result, the multi-layer film S is formed.

The zipper member introduction unit 23 inserts the zipper member 14 supplied from a zipper member supply device between the inner surfaces of the resin films 13*a* and 13*b* so that the longitudinal direction follows the conveying direction C. After that, the resin films 13*a* and 13*b* are superposed on each other to form the multi-layer film S.

The dancer roll 31 is a pair of rolls that keep the tension of the resin films 13*a* and 13*b* on the bag making machine 20 constant. When the dancer roll 31 moves up and down (i.e., reciprocates), the resin films 13*a* and 13*b* are continuously conveyed between the resin film supply unit 21 and the dancer roll 31. Between the dancer roll 31 and the rear stage conveying roll 36, the resin films 13*a* and 13*b* are intermittently conveyed in accordance with the length of one zipper bag 1 to be manufactured in a state in which the alignment is performed in the conveying direction C.

The zipper seal device 24 is equipped with a heating head and a platform. The zipper seal device 24 is a device that thermally fuses the zipper member 14 disposed between the resin films 13*a* and 13*b* to the resin films 13*a* and 13*b* via the thermal fusion layer 133 (see FIG. 2). In the multi-layer film S that has passed through the zipper seal device 24, the zipper member 14 is joined between the resin films 13*a* and 13*b* (on the resin films 13*a* and 13*b*) so that the longitudinal direction of the zipper member 14 follows the conveying direction C of the multi-layer film S. Such a zipper seal device 24 operates in synchronization with the vertical edge sealing device 25.

The vertical edge sealing device 25 is equipped with a heating head and a platform. The vertical edge sealing device 25 thermally fuses the resin film 13*a* and the resin film 13*b* constituting the multi-layer film S at a predetermined width in the conveying direction C, at a position corresponding to the bottom portion 1D in the zipper bag 1 (see FIG. 1). Such a vertical edge sealing device 25 operates in synchronization with the zipper seal device 24. In this case, the user thermally fuses the opening portion 1A after accommodating the contents from the opening portion 1A. The vertical edge sealing device 25 may thermally fuse the resin film 13*a* and the resin film 13*b* constituting the multi-layer film S at a predetermined width in the conveying direction C, at a position corresponding to the opening portion 1A in the zipper bag 1 (see FIG. 1). In this case, a user thermally fuses the bottom portion 1D after accommodating the contents from the bottom portion 1D.

The first cooling unit 33 is equipped with a cooling head and a platform. The first cooling unit 33 has, for example, a water cooling device, and has a structure in which a temperature rise is suppressed by making the cooling water flow through a refrigerant pipe formed inside a cooling head and a platform. As a result, the multi-layer film S heated by thermal fusion in the zipper seal device 24 and the vertical edge sealing device 25 is cooled. Further, in the process of making the zipper bag 1, the multi-layer film S is prevented from being deformed due to heat. That is, in the process of making the zipper bag 1, the multi-layer film S is prevented from being deformed due to heat shrinkage or the like. The first cooling unit 33 operates in synchronization with the zipper seal device 24 and the vertical edge sealing device 25. The first cooling unit 33 may be configured to be cooled by an air cooling device in addition to the water cooling device.

As shown in FIG. 4, the ultrasonic device 26 has an anvil (i.e., platform) 41 that supports the other surface side (i.e., a lower side in FIG. 3) of the multi-layer film S, and an ultrasonic horn head 42 that moves up and down (i.e., reciprocates) between a position (i.e., an applied position) adjacent to one surface side (i.e., an upper side in FIG. 3) of the multi-layer film S and a position (i.e., a retracted position) separated from the one surface side. The ultrasonic horn head 42 is not limited to one that moves up and down as in the present embodiment, but may be configured to reciprocate in an optimum direction according to the conveying direction C of the resin films 13*a* and 13*b*.

In the ultrasonic device 26, both end portions of the zipper member 14 in the longitudinal direction, that is, the portion of the zipper member 14 corresponding to (overlapping) the side edge portions 1B and 1C of the zipper bag 1 within the zipper member 14 disposed in the width direction W to extend in the longitudinal direction in FIG. 1, is disposed between the ultrasonic horn head 42 and the anvil (i.e., platform) 41 via the multi-layer film S, and the ultrasonic horn head 42 is urged toward the anvil (i.e., platform) 41. As a result, the ultrasonic horn head 42 applies the ultrasonic vibration to the zipper member 14, softens the zipper member 14 with the ultrasonic vibration, and crushes the zipper member 14 flat so that the thickness of the zipper member 14 becomes substantially uniform.

As shown in FIG. 4, the ultrasonic horn head 42 is in contact with zipper member 14 via the resin film 13 at the application position, and the multi-layer film S is conveyed in the conveying direction C when it is at the retracted position. The anvil (i.e., platform) 41 of the ultrasonic device 26 is preferably formed so that the ultrasonic vibration applied by the ultrasonic horn head 42 is concentrated on both end portions of the zipper member 14.

The side edge sealing device 27 has a platform 44 that supports the other surface side (i.e., a lower side in FIG. 3) of the multi-layer film S, and a heat-generating head 45 that moves up and down (i.e., reciprocates) between a position (i.e., a heating position) adjacent to one surface side (i.e., an upper side in FIG. 3) of the multi-layer film S and a position (i.e., a retracted position) separated from the one surface side. The heat-generating head 45 is not limited to one that moves up and down as in the present embodiment, and may be configured to reciprocate in the optimum direction according to the conveying direction C of the resin films 13*a* and 13*b*.

The heat-generating head 45 constituting the side edge sealing device 27 is crimped to the platform 44 via portions corresponding to both side portions of the bag 1 with zipper including the zipper member 14 crushed by the ultrasonic device 26 in the previous process and the multi-layer film S, and forms side edge portions 1B and 1C (see FIG. 1).

As shown in FIG. 4, the link member 51 is connected to a single rotating device (for example, a servo motor) 57 and a cam mechanism (for example, an eccentric cam device) 56. The ultrasonic horn head 42 constituting the ultrasonic device 26 is engaged with the link member (i.e., a link bar) 51 via a connecting member 52. Further, the heat-generating head 45 constituting the side edge sealing device 27 is also engaged with the link member 51 via the connecting member 53. The link member 51 is engaged with the connecting rod 55 via interlocking members 54*a*, 54*b* and 54*c* in a freely rotatable manner. The connecting rod 55 is connected to a single servo motor (i.e., a rotating device) 57 via an eccentric cam device (i.e., a cam mechanism) 56 and a belt 58.

The drive mechanism 50 having the above configuration moves the ultrasonic horn head 42 and the heat-generating head 45 up and down (i.e., moves to reciprocate) together at the same cycle without causing any deviation, via the link member 51 to which the ultrasonic horn head 42 and the heat-generating head 45 are commonly connected, by rotating one servo motor 57. However, the drive mechanism 50 is not limited to such a configuration, as long as it is possible to move the link member 51 up and down (i.e., moves to reciprocate) to move the ultrasonic horn head 42 and the heat-generating head 45 up and down (i.e., moves to reciprocate) together at the same cycle without causing any deviation. For example, a line slider, a motor and a ball screw, a hydraulic cylinder, and the like may be used.

The connecting member 52 that connects the ultrasonic horn head 42 and the link member 51 may be formed on one side or both sides of the width direction W in the bag making machine 20 of the present embodiment. Further, the connecting member 53 that connects the heat-generating head 45 and the link member 51 may also be formed on one side or both sides of the width direction W in the bag making machine 20 of the present embodiment.

Further, the ultrasonic horn head 42 and the heat-generating head 45 may be configured to be urged by a spring toward one side (i.e., an upper side in FIG. 3) of the multi-layer film S. That is, the ultrasonic horn head 42 may be urged toward the multi-layer film S by a spring. By providing such a spring, the pressing force of the ultrasonic horn head 42 and the heat-generating head 45 against the multi-layer film S is increased, and ultrasonic waves and heat can be more reliably applied to the multi-layer film S. However, even if the spring is not provided, the ultrasonic horn head 42 and the heat-generating head 45 can apply ultrasonic waves or heat to the multi-layer film S. An urging member for pressing the ultrasonic horn head 42 and the heat-generating head 45 against the multi-layer film S is not limited to the spring. For example, the urging member may be an elastic member such as rubber.

If the heating head of the zipper seal device 24 and the heating head of the vertical edge sealing device 25 are connected to the link member 51 in addition to the ultrasonic horn head 42 and the heat-generating head 45, the drive mechanism 50 can also move the heating heads up and down (i.e., moves to reciprocate) at the same cycle (as the ultrasonic horn head 42 and the heat-generating head 45).

As described above, according to the bag making machine 20 of the present invention, the ultrasonic horn head 42 of the ultrasonic device 26 that crushes both end portions of the zipper member 14, and the heat-generating head 45 of the side edge sealing device 27 forming the side edge portions 1B and 1C (see FIG. 1) to sandwich both end portions of the crushed zipper member 14 between the resin film 13*b* and the resin film 13*a* can be moved up and down (i.e., moved to reciprocate) at the same cycle without causing a synchronization deviation with each other.

Further, such a drive mechanism 50 can move the ultrasonic horn head 42 up and down (i.e., reciprocally move) by a rotating device that can easily increase the rotation speed, for example, a servo motor 57. Therefore, the number of vertical movements of the ultrasonic horn head 42 per unit time can be easily enhanced compared with a conventional ultrasonic device which moves the ultrasonic horn head up and down (i.e., reciprocally move) by an air cylinder having a slow response speed.

In addition, since the conventional ultrasonic device using an air cylinder has a structure in which the air cylinder extends long in the vertical direction, it was necessary to increase a height of an installation location of the bag making machine. However, the bag making machine 20 of the present embodiment does not use an air cylinder. Therefore, the bag making machine 20 can be installed even if the height of the installation location is low, and the restrictions on the size of the installation location can be reduced. That is, an indoor height that can accommodate an air cylinder was required at the installation location (i.e., installation space) in which the conventional bag making machine is installed. However, the installation location in which the bag making machine 20 of the present embodiment is installed does not require an indoor height capable of accommodating an air cylinder. Therefore, the size of the installation location in which the bag making machine 20 of the present embodiment is installed can be smaller in the vertical direction than the installation location in which the conventional bag making machine is installed. That is, according to the bag making machine 20 of the present embodiment, the restrictions required for the size of the installation location can be reduced.

Further, the vertical movement referred to here shows a specific example of the operating direction in the present embodiment as an example of the present invention. Therefore, the ultrasonic horn head 42, the heat-generating head 45, the heating head of the zipper seal device 24, and the heating head of the vertical edge sealing device 25 may be configured to reciprocate in the optimum direction according to the conveying direction C of the resin films 13*a* and 13*b*.

The second cooling unit 35 is equipped with a cooling head and a platform. The second cooling unit 35 has, for example, a water cooling device, and has a structure in which a temperature rise is suppressed by making the cooling water flow through a refrigerant pipe formed inside the cooling head and the platform. As a result, the multi-layer film S heated by the ultrasonic device 26 and the side edge sealing device 27 is cooled. Further, in the making process of the bag 1 with zipper, the multi-layer film S is prevented from being deformed due to heat. That is, in the making process of the bag 1 with zipper, the multi-layer film S is prevented from being deformed due to heat shrinkage or the like. The second cooling unit 35 operates in synchronization with the ultrasonic device 26 and the side edge sealing device 27. The second cooling unit 35 may be configured to be cooled by an air cooling device in addition to the water cooling device.

The cutter unit 28 intermittently moves the cutting blade up and down (i.e., reciprocally move) for each length of one bag 1 with zipper to cut each bag 1 with zipper from the multi-layer film S.

From the above, as an example, the bag making machine 20 of the above embodiment has a conveying unit 37 that conveys the multi-layer film S in which the strip-shaped films 13*a* and 13*b* are overlapped, a side edge sealing device 27 that thermally fuses the films 13*a* and 13*b* to each other at predetermined intervals along the width direction that is perpendicular to the conveying direction C of the multi-layer film S, and an ultrasonic device 26 that is disposed on an upstream side of the side edge sealing device 27 in the conveying direction C to soften and crush a part of the zipper member 14 disposed between the films 13*a* and 13*b* so that the longitudinal direction follows the conveying direction C by ultrasonic waves. The side edge sealing device 27 has a platform 44 that supports the multi-layer film S, and a heat-generating head 45 that reciprocates between a position adjacent to the multi-layer film S and a position separated from the multi-layer film S. The ultrasonic device 26 has an anvil 41 that supports the multi-layer film S, and an ultrasonic horn head 42 that reciprocates between a position adjacent to the multi-layer film S and a position separated from the multi-layer film S. The heat-generating head 45 and the ultrasonic horn head 42 reciprocate at the same cycle via the link member 51 common to each other.

The present invention is not limited to the above-described embodiment described referring to the drawings, and various modified examples can be considered within the technical scope thereof.

Figure 5:
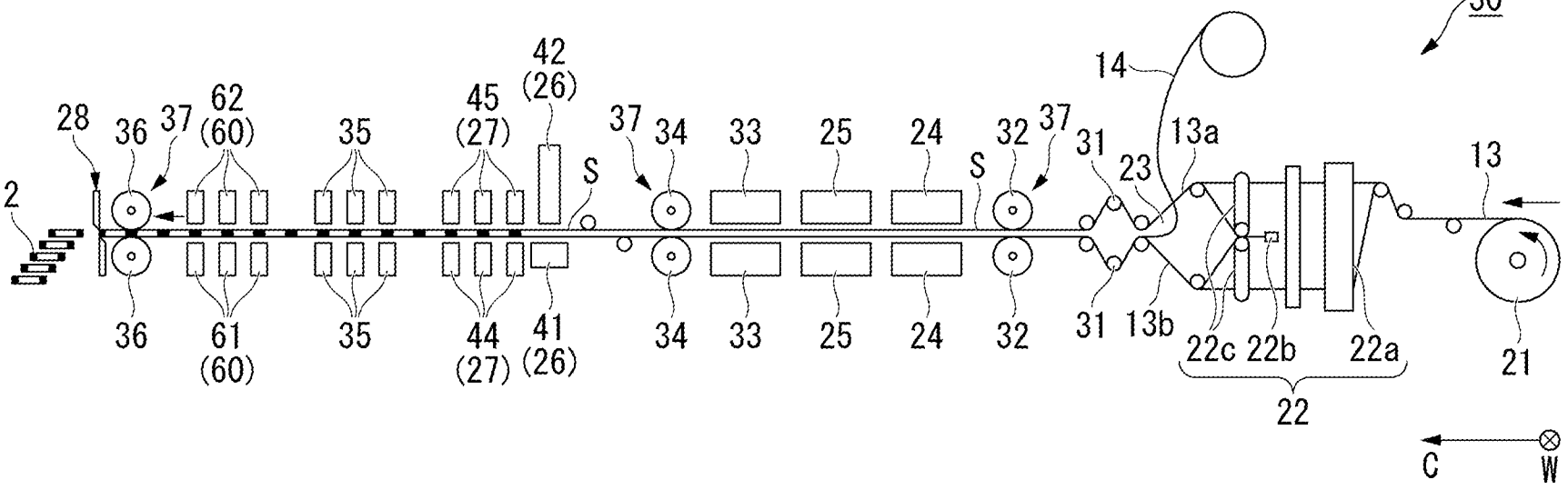
FIG. 5 is a schematic view showing a schematic configuration of a bag making machine according to a modified example of an embodiment of the present invention.

For example, FIG. 5 is a schematic diagram showing a schematic configuration of a bag making machine according to a modified example of the above embodiment. In a bag making machine 30 of the modified example, a punching device 60 is formed in addition to the bag making machine 20 of the above embodiment. In the bag making machines 30 of the modified example, the same constituent elements as the bag making machine 20 of the above embodiment are designated by the same reference numerals.

The bag making machine 30 has a punching device 60 that is disposed on the downstream side of the side edge sealing device 27 in the conveying direction C to punch (i.e., cut) a part of the multi-layer film S. The punching device 60 is disposed between the second cooling unit 35 and the rear stage conveying roll 36 in the conveying direction C. Further, the punching device 60 has a female blade 61 that supports the multi-layer film S, and a male blade 62 that reciprocates between a position at which it is fitted to the female blade 61 and punches a part of the multi-layer film S and a position separated from the multi-layer film S, and punches a part of the multi-layer film S. The female blade 61 and the male blade 62 may be interpreted as members including a blade and a platform on which the blade can be installed, respectively. Further, the heat-generating head 45, the ultrasonic horn head 42, and the male blade 62 reciprocate at the same cycle via the link member 51. The heat-generating head 45, the ultrasonic horn head 42, and the male blade 62 are connected to the link member 51 and move up and down (i.e., reciprocally move) at the same cycle. The male blade 62 and the link member 51 are connected in the same manner as the heat-generating head 45 and the link member 51, and the ultrasonic horn head 42 and the link member 51.

According to such a bag making machine 30, the multi-layer film S can be subjected to a punching process by the punching device 60. For example, a notch (i.e., cut), a corner cut (i.e., round cut, etc.), a hook hole, and the like can be formed in the multi-layer film S. Further, the heat-generating head 45, the ultrasonic horn head 42, and the male blade 62 can be moved up and down (i.e., reciprocally move) at the same cycle.

Figure 6:
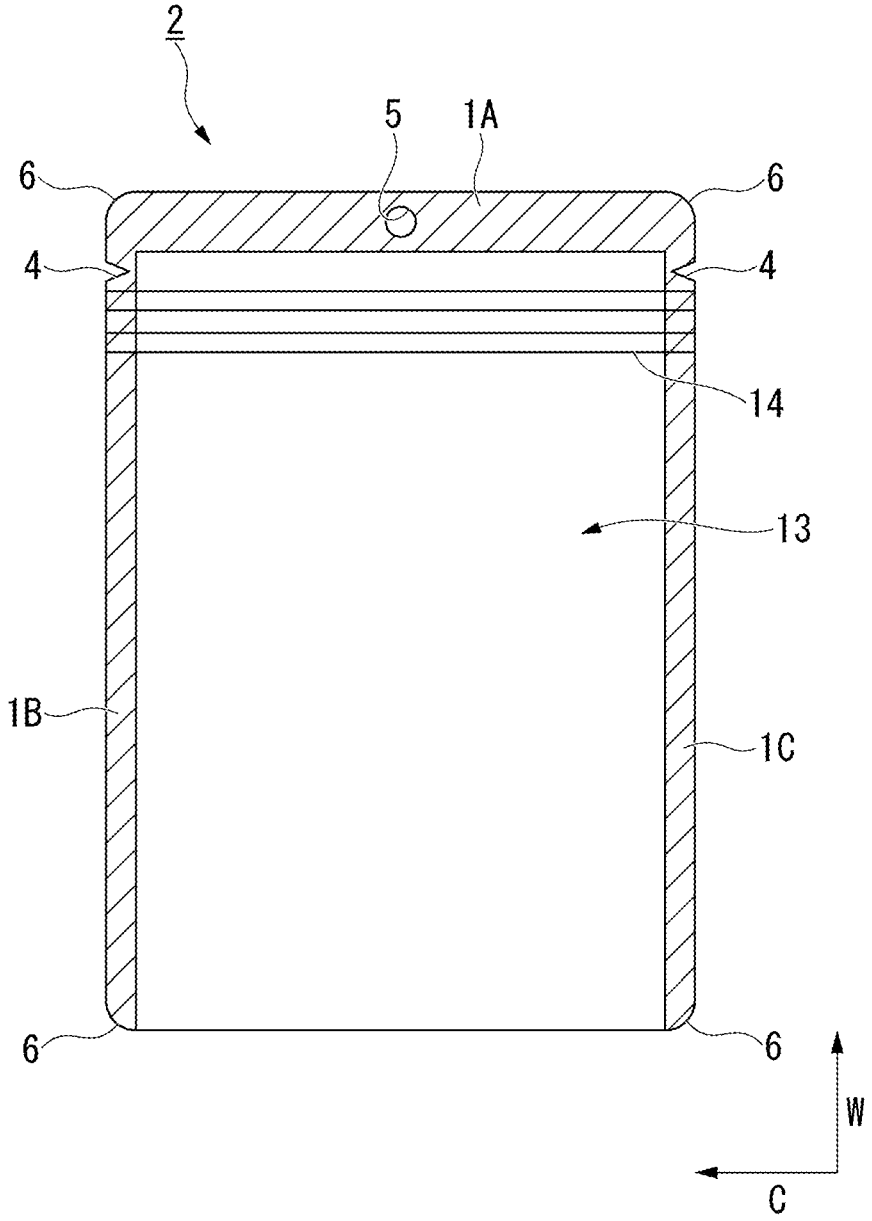
FIG. 6 is a front view showing an example of a zipper bag according to a modified example of an embodiment of the present invention.

The punching process of the punching device 60 will be described. FIG. 6 shows an example of a bag with zipper according to a modified example of the above embodiment. In a bag 2 with zipper of the modified example, the same constituent elements as the bag 1 with zipper of the above embodiment are designated by the same reference numerals. The bag 2 with zipper can be manufactured by punching the multi-layer film S with the punching device 60. In the punching device 60, the male blade for forming the notch 3 among the male blades 62 punches a part of the multi-layer film S so that the notch 4 is formed in the bag 2 with zipper between the opening portion 1A of the side edge portion 1B and the side edge portion 1C and the zipper member 14. Further, the male blade for forming the corner cut 6 among the male blades 62 punches a part of the multi-layer film S so that the corner cuts (i.e., round cuts) 6 are formed at the four corners of the bag 2 with zipper. Further, the male blade for forming the hook hole 5 among the male blades 62 punches a part of the multi-layer film S so that the hook hole 5 is formed at the center position in the longitudinal direction (i.e., conveying direction C) of the opening portion 1A of the bag 2 with zipper. In the bag 2 with zipper, the resin films 13*a* and 13*b* are thermally fused with a predetermined width along the conveying direction C at a position corresponding to the opening portion 1A (see FIG. 1) by the vertical edge sealing device 25.

The arrangement of the punching device 60 will be described. The punching device 60 is disposed on the downstream side of the side edge sealing device 27 in the conveying direction C, and is disposed between the second cooling unit 35 and the rear stage conveying roll 36 in the conveying direction C. This is because the thermally fused portion of the multi-layer film S is subjected to punching process. The thermally fused portions of the multi-layer film S are the opening portion 1A, the side edge portion 1B, and the side edge portion 1C when the vertical edge sealing device 25 seals the opening portion 1A. Further, the thermally fused portions are the bottom portion 1D, the side edge portion 1B, and the side edge portion 1C when the vertical edge sealing device 25 seals the bottom portion 1D. Even if an attempt is made to punch a portion of the multi-layer film S that is not thermally fused, the resin films 13*a* and 13*b* easily slide, and the male blade 62 is hard to punch a part of the multi-layer film S. Even if a part of the portion of the multi-layer film S that is not thermally fused can be punched, high-precision punching cannot be realized. Further, even if a non-slip material is selected for the resin films 13*a* and 13*b* to maintain a high accuracy of punching, there is a likelihood that the handling performance of the bag 2 with zipper may deteriorate. Further, even if the non-thermally fused portion of the multi-layer film S that has been completely punched is thermally fused, there is a likelihood that the resin films 13*a* and 13*b* may be thermally fused in the state in which a notch, a corner cut, a hook hole, and the like formed in each of the resin films 13*a* and 13*b* are displaced from each other. Furthermore, there is a likelihood that the thermal fusion layer 133 is melted from the cut surface formed by punching the notch, the corner cut, the hook hole, and the like and the appearance of the bag 2 with zipper may deteriorate. Therefore, by disposing the punching device 60 between the second cooling unit 35 and the rear stage conveying roll 36 in the conveying direction C, it is possible to perform the punching process on the thermally fused portions (i.e., the portion in which the resin films 13*a* and 13*b* do not deviate from each other) of the film S.

A power source of the punching device 60 will be described. In general, the power source of the punching device is an air cylinder, which is different from the power source of the sealing device (i.e., the side edge sealing device, and the ultrasonic device). However, in a case where the power source of the punching device is an air cylinder, there is a likelihood that the operation of the punching device may not be able to accurately follow the operation of the bag making machine when the bag making machine is operated at high speed. In such a case, the punching process as designed cannot be realized. Therefore, products with poor appearance or contamination of contaminations (i.e., products cut into a shape different from the desired shape, products in which the debris remains without being removed, and the like) are likely to occur.

In contrast, according to the bag making machine 30 of the modified example, when the modified example bag making machine 30 is operated at high speed, the followability of the operation of the punching device 60 to the operation of the bag making machine 30 can be improved. As a result, it is possible to make it difficult to generate a product with a poor appearance or contamination which is likely to occur when the power source of the punching device is an air cylinder. Therefore, when the punching device 60 is provided in the bag making machine 20 as in the bag making machine 30 of the modified example, it is also sufficient to move the male blade 62 up and down (i.e., reciprocally move) at the same cycle as the heat-generating head 45 and the ultrasonic horn head 42.

(Bag Making Method)

A bag making method according to the embodiment of the present invention is a method of manufacturing the bag 1 with zipper using the bag making machine 20 having the above-described configuration, and includes at least one of a process of placing the zipper member 14 between the resin films 13*a* and 13*b* so that the longitudinal direction follows the conveying direction C in the zipper member introduction unit 23, a process of softening and crushing both end portions of the zipper member 14 by ultrasonic waves using the ultrasonic device 26, and a process of thermally fusing the resin films 13*a* and 13*b* at predetermined intervals along the width direction W.

According to the bag making method of the embodiment of the present invention, the ultrasonic horn head 42 of the ultrasonic device 26 and the heat-generating head 45 of the side edge sealing device 27 are synchronized without any deviation. Therefore, the manufactured bag 1 with zipper does not have wrinkles due to a synchronization deviation. Further, the ultrasonic horn head 42 of the ultrasonic device 26 is reciprocally moved by a rotating device such as a servo motor 57. Therefore, the productivity of the bag 1 with zipper can be improved.

The present invention is not limited to the bag making method using the bag making machine of the above-described embodiment described with reference to the drawings, and various modified examples can be considered within the technical scope thereof.

For example, as shown in FIG. 5, the bag making method using the bag making machine 30 of the modified example includes a process of punching the multi-layer film S by a punching device 60, in addition to the bag making method using the bag making machine 20 of the above-described embodiment. According to the bag making method of the modified example of the present invention, the ultrasonic horn head 42 of the ultrasonic device 26, the heat-generating head 45 of the side edge sealing device 27, and the male blade 62 of the punching device 60 are synchronized without deviation. Therefore, the manufactured bag 2 with zipper does not have wrinkles due to synchronization deviation, and a poor appearance or contamination are less likely to occur.

Although the embodiments of the present invention have been described above, these embodiments are presented as examples and are not intended to limit the scope of the invention. These embodiments can be implemented in various other forms, and various omissions, replacements, and changes can be made without departing from the spirit of the invention. These embodiments and modifications thereof are included in the scope and spirit of the invention, and are also included in the scope of the invention described in the claims and the equivalent scope thereof.

INDUSTRIAL APPLICABILITY

According to the present invention, it is possible to provide a bag making machine that enables improvement in manufacturing efficiency of a bag with zipper and facilitates synchronization of each process.

REFERENCE SIGNS LIST

1, 2 Bag with zipper
4 Notch
5 Hook hole
6 Corner cut
1A Opening portion
1B, 1C Side edge portion
1D Bottom portion
13, 13*a*, 13*b* Resin film
14 Zipper member
20 Bag making machine
21 Resin film supply unit
22 Inversion cutting unit
23 Zipper member introduction unit
24 Zipper seal device
25 Vertical edge sealing device
26 Ultrasonic device
27 Side edge sealing device
28 Cutter unit
41 Anvil (i.e., platform)
42 Ultrasonic horn head
45 Heat-generating head
51 Link member (i.e., link bar)
56 Eccentric cam device (i.e., cam mechanism)
57 Servo motor (i.e., rotating device)
60 Punching device
61 Female blade
62 Male blade
C Conveying direction
S Multi-layer film
W Width direction

The invention claimed is:

1. A bag making machine comprising:

a conveying unit which conveys a multi-layer film in which strip-shaped films are overlapped;

a side edge sealing device which thermally fuses the films to each other at predetermined intervals in a width direction that is perpendicular to a conveying direction of the multi-layer film; and an ultrasonic device which is disposed on an upstream side of the side edge sealing device in the conveying direction and softens and crushes a part of a zipper member with ultrasonic waves, the zipper member disposed between the films such that a longitudinal direction follows the conveying direction, wherein the side edge sealing device includes:

a platform which supports the multi-layer film, and a heat-generating head which reciprocates between a position adjacent to the multi-layer film and a position separated from the multi-layer film, the ultrasonic device includes:

an anvil which supports the multi-layer film, and an ultrasonic horn head which reciprocates between a position adjacent to the multi-layer film and a position separated from the multi-layer film, and the heat-generating head and the ultrasonic horn head reciprocate at a same cycle via a link member common to the heat-generating head and the ultrasonic horn.

2. The bag making machine according to claim 1, wherein the link member is connected to a single rotating device and a cam mechanism.

3. The bag making machine according to claim 1, wherein the ultrasonic horn head is urged toward the multi-layer film by a spring.

4. The bag making machine according to claim 1, further comprising:

a punching device which is disposed on a downstream side of the side edge sealing device in the conveying direction and punches a part of the multi-layer film, wherein the punching device includes:

a female blade which supports the multi-layer film, and a male blade which reciprocates between a position at which the male blade is fitted into the female blade and in which the male blade punches a part of the multi-layer film and a position separated from the multi-layer film, and which punches the part of the multi-layer film, and the heat-generating head, the ultrasonic horn head, and the male blade reciprocate at the same cycle via the link member.

5. A bag-making method using the bag making machine according to claim 1, the method comprising at least:

placing the zipper member between the films such that the longitudinal direction follows the conveying direction;

softening and crushing both end portions of the zipper member with ultrasonic waves; and thermally fusing the films at predetermined intervals in the width direction.

* * * * *